US009010962B2

(12) United States Patent
Kim et al.

(10) Patent No.: US 9,010,962 B2
(45) Date of Patent: Apr. 21, 2015

(54) OPTICAL SEMICONDUCTOR LIGHTING APPARATUS

(75) Inventors: Ji Wan Kim, Seongnam (KR); Min Uk Yoo, Seongnam (KR); Min Su Kim, Seongnam (KR); Jung Hwa Kim, Seongnam (KR)

(73) Assignee: Posco LED Company Ltd., Yongin-si (KR)

( * ) Notice: Subject to any disclaimer, the term of this patent is extended or adjusted under 35 U.S.C. 154(b) by 268 days.

(21) Appl. No.: 13/596,580

(22) Filed: Aug. 28, 2012

(65) Prior Publication Data

US 2014/0009933 A1 Jan. 9, 2014

(30) Foreign Application Priority Data

Jul. 4, 2012 (KR) ..... 10-2012-0072919
Jul. 16, 2012 (KR) ..... 10-2012-0077197

(51) Int. Cl.

| | |
|---|---|
| ***F21V 29/00*** | (2006.01) |
| ***F21V 7/00*** | (2006.01) |
| ***F21V 23/02*** | (2006.01) |
| ***F21V 17/00*** | (2006.01) |
| *F21Y 101/02* | (2006.01) |

(52) U.S. Cl.

CPC ..... *F21V 23/023* (2013.01); *F21V 17/005* (2013.01); *F21V 17/007* (2013.01); *F21Y 2101/02* (2013.01); *F21V 29/15* (2013.01); *F21V 29/773* (2013.01)

(58) Field of Classification Search

None

See application file for complete search history.

(56) References Cited

U.S. PATENT DOCUMENTS

| | | | | |
|---|---|---|---|---|
| 4,378,584 | A | 3/1983 | Russello | |
| 4,661,892 | A | 4/1987 | Reed, Jr. | |
| 8,449,154 | B2 | 5/2013 | Uemoto et al. | |
| 2009/0296414 | A1* | 12/2009 | Moriyama et al. | 362/373 |
| 2010/0302777 | A1* | 12/2010 | Knoll et al. | 362/235 |
| 2012/0044704 | A1 | 2/2012 | Wilson et al. | |
| 2012/0307501 | A1* | 12/2012 | Tankala et al. | 362/294 |

FOREIGN PATENT DOCUMENTS

| | | |
|---|---|---|
| CN | 201696993 | 1/2011 |
| JP | 2009-129809 | 6/2009 |
| JP | 2010-010124 | 1/2010 |

(Continued)

OTHER PUBLICATIONS

Patent Examination Report issued on Jan. 13, 2015, in Australian Patent Application No. 2012384645.

*Primary Examiner* — Ashok Patel

(74) *Attorney, Agent, or Firm* — H.C. Park & Associates, PLC

(57) ABSTRACT

An adjusting unit disposed between a housing including at least one or more semiconductor optical devices and a case accommodating an SMPS, so as to adjust the height of the casing. At least one or more light emitting modules are mounted on the bottom surface of the housing, and a position determining unit is disposed in the housing in correspondence to an edge of the light emitting module. A heat sink unit is provided in correspondence to the top surface of the housing. Therefore, transport costs can be significantly reduced by securing the loading space. The semiconductor optical devices serving as a light source can be appropriately arranged, and the semiconductor optical devices can be mounted at accurate positions. Furthermore, products can be rapidly mass-produced due to a simplified manufacturing process thereof.

18 Claims, 5 Drawing Sheets

(56) References Cited

FOREIGN PATENT DOCUMENTS

| | | |
|---|---|---|
| JP | 2010-016003 | 1/2010 |
| JP | 2011515816 | 5/2011 |
| KR | 10-2007-0001445 | 1/2007 |
| KR | 10-0949452 | 3/2010 |
| KR | 10-1077476 | 10/2011 |
| WO | 2009119929 | 10/2009 |
| WO | 2010146917 | 12/2010 |
| WO | 2011039998 | 4/2011 |

* cited by examiner

OPTICAL SEMICONDUCTOR LIGHTING APPARATUS

CROSS-REFERENCE(S) TO RELATED APPLICATION

This application claims priority in Korean Patent Application No. 10-2012-0072919, filed on Jul. 4, 2012, and in Korean Patent Application No. 10-2012-0077197, filed on Jul. 16, 2012, which are hereby incorporated by reference in their entirety.

BACKGROUND OF THE INVENTION

1. Field of the Invention

The present invention relates to an optical semiconductor lighting apparatus.

2. Description of the Related Art

Compared with incandescent light and fluorescent light, optical semiconductors, such as LEDs or LDs, consume low power, have a long lifespan, and have high durability and high brightness. Due to these advantages, optical semiconductors have recently attracted much attention as one of components for lighting.

Typically, a lighting apparatus using an optical semiconductor as a light source is configured such that a power supply (hereinafter, referred to as an SMPS) is mounted on a housing in which the optical semiconductor is disposed.

The SMPS is connected to the optical semiconductor and supplies power. Generally, a heat sink provided in the housing is interposed between the SMPS and the optical semiconductor, so that heat generated from the optical semiconductor cannot be directly transferred to the SMPS.

However, the lighting apparatus using the optical semiconductor as the light source may be used for factory light or security light. In order to use the lighting apparatus for the above-described purpose, it is necessary to smoothly supply power, and thus, the size of the SMPS also increases.

Therefore, the above-described SMPS protrudes from a light emitting module, which includes the optical semiconductor and is disposed in the housing, to a considerable height. Due to the protruding height of the SMPS, a space occupied by individual lighting apparatuses also increase proportionally. Hence, a large space is required for loading and transport.

Furthermore, the lighting apparatus using the optical semiconductor is generally configured such that a plurality of optical semiconductors are disposed in a light emitting module, the light emitting module is mounted on one side of the housing, and a heat sink is disposed on the other side of the housing so as to discharge and cool heat generated from the light emitting module.

Generally, the light emitting module may be manufactured by arranging the optical semiconductors on a printed circuit board in specific patterns. The shape of the printed circuit board may be determined according to the arranged patterns of the optical semiconductors and the shape of the housing.

However, satisfactory research and development has not been made to check an accurate position of the housing, to which a light emitting module is to be arranged and fixed, and many related products have not been launched. Therefore, an operator has checked an appropriate position of the housing, to which the light emitting module is to be arranged and fixed, with the naked eyes. As a result, it takes a considerable time to check the position of the housing and connect the light emitting module to the housing.

SUMMARY OF THE INVENTION

An aspect of the present invention is directed to provide an optical semiconductor lighting apparatus that can significantly reduce transport costs by securing the loading space.

Another aspect of the present invention is directed to provide an optical semiconductor lighting apparatus that is designed to appropriately arrange semiconductor optical devices serving as a light source, and mount the semiconductor optical devices at accurate positions.

Another aspect of the present invention is directed to provide an optical semiconductor lighting apparatus that can be rapidly mass-produced due to a simplified manufacturing process thereof.

According to an embodiment of the present invention, an optical semiconductor lighting apparatus includes: a housing; a light emitting module disposed on a bottom surface of the housing and including at least one or more semiconductor optical devices; a position determining unit disposed on the bottom surface of the housing and corresponding to an edge of the light emitting module; and a heat sink unit disposed on a top surface of the housing and corresponding to the light emitting module.

The light emitting module may be disposed in a plurality of mounting areas partitioned by the position determining unit on the bottom surface of the housing.

The optical semiconductor lighting apparatus may further include at least one waterproof connector disposed at one side of the bottom surface of the housing.

The light emitting module may be disposed in a plurality of mounting areas radially partitioned by the position determining unit on the bottom surface of the housing.

The optical semiconductor lighting apparatus may further include a waterproof connector disposed in the center of the bottom surface of the housing.

The position determining unit may include: at least one or more first ribs protruding from the bottom surface of the housing in a horizontal or vertical direction; and a plurality of second ribs protruding from an edge of the bottom surface of the housing, wherein the light emitting module is disposed in a plurality of mounting areas between the first and second ribs.

The first ribs of the position determining unit may be disposed across a center portion of the bottom surface of the housing.

The first ribs of the position determining unit may be arranged on a first virtual straight line, which is disposed on the bottom surface of the housing, and a second virtual straight line, which is perpendicular to the first virtual straight line.

The first ribs of the position determining unit may be arranged on a plurality of first virtual straight lines, which are disposed on the bottom surface of the housing, and a plurality of second virtual straight lines, which are perpendicular to the first virtual straight lines.

The position determining unit may include: a plurality of third ribs protruding radially from the center of the bottom surface of the housing, and a plurality of fourth ribs protruding from an edge of the bottom surface of the housing, wherein the light emitting module is disposed in a plurality of mounting areas between the third and fourth ribs.

The optical semiconductor lighting apparatus may further include: a main reflector connected to an edge of the housing; and an auxiliary reflector having an inclined surface formed along the edge of the housing.

The heat sink unit may include a plurality of heat sink fins protruding from the top surface of the housing in correspondence to an area where the edge of the light emitting module is formed.

The heat sink unit may include a plurality of heat sink fins formed radially from a center of the top surface of the housing.

According to another embodiment of the present invention, an optical semiconductor lighting apparatus includes: a housing; at least one engine body disposed on a bottom surface of the housing and including a semiconductor optical device; a position determining unit disposed on the bottom surface of the housing and corresponding to an edge of the engine body; and a heat sink unit disposed on a top surface of the housing and corresponding to the light emitting module.

The engine body may be formed to have a top surface gradually widened from one side to the other side.

The term "semiconductor optical device" used in claims and the detailed description refers to light emitting diode (LED) chips or the like that includes or uses an optical semiconductor.

The semiconductor optical devices may include package level devices with various types of optical semiconductors, including the LED chip.

DETAILED DESCRIPTION OF EXEMPLARY EMBODIMENTS

Exemplary embodiments of the present invention will be described below in detail with reference to the accompanying drawings.

Figure 1:
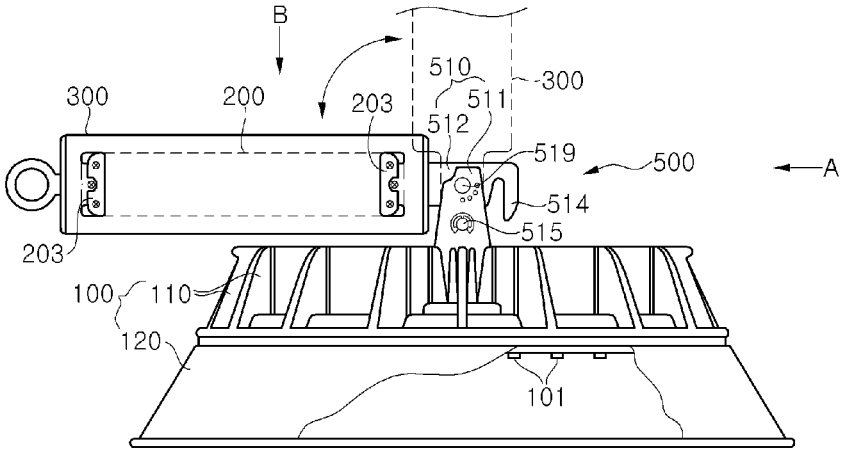
FIG. 1 is a side conceptual diagram illustrating an overall configuration of an optical semiconductor lighting apparatus according to an embodiment of the present invention.

FIG. 1 is a side conceptual diagram illustrating an overall configuration of an optical semiconductor lighting apparatus according to an embodiment of the present invention.

As illustrated, the optical semiconductor lighting apparatus according to the embodiment of the present invention is configured such that an adjusting unit 500 is mounted between a casing 300 and a housing 100. The casing 300 is configured to accommodate a power supply (hereinafter, referred to as an SMPS) 200.

The housing 100 includes at least one or more semiconductor optical devices 101, and provides a space for mounting the casing 300 through the adjusting unit 500 which will be described later.

The SMPS 200 supplies power to the semiconductor optical devices 101.

The casing 300 accommodates the SMPS 200, and is configured such that the semiconductor optical devices 101 and the SMPS 200 are not arranged adjacent to each other through the adjusting unit 500 which will be described later. Therefore, the casing 300 prevents heat generated from the semiconductor optical devices 101 from being directly transferred to the SMPS 200.

The adjusting unit 500 is arranged between the housing 100 and the casing 300, and serves to change the height of the casing 300 protruding from the housing 100.

Therefore, when installed and used in the actual fields, the adjusting unit 500 may be arranged vertically to the top surface of the housing 100, like the position of the casing 300 indicated by dotted lines in FIG. 1.

Also, when it is necessary to reduce a total volume upon loading and transport, the adjusting unit 500 may be arranged in parallel to the top surface of the housing 100, like the position of the casing 300 indicated by solid lines.

It is apparent that the following various embodiments as well as the above-described embodiment can also be applied to the present invention.

As described above, the housing 100 includes semiconductor optical devices 101, a heat sink 110 disposed in the vicinity of the semiconductor optical devices 101 so as to discharge heat generated from the semiconductor optical devices 101, and a reflector 120 extending along an edge of an area where the semiconductor optical devices 101 are disposed.

Meanwhile, as described above, the adjusting unit 500 changes the height of the casing 300 with respect to the housing 100, and may include a rotatable assembly 510 for rotating the casing 300 with respect to the housing 100.

That is, the rotatable assembly 510 includes a first portion 511 protruding from the housing 100, and a second portion 512 provided at one side of the casing 300 and rotating around the first portion 511.

The rotatable assembly 510 includes a latch hook 514 at an end of the second portion 512. A latch pin 515 is disposed at the first portion 511 in the vicinity of a hinge pin 519 that mutually connects the first portion 511 and the second portion 512. The latch hook 514 is connected to the latch pin 515.

Figure 2:
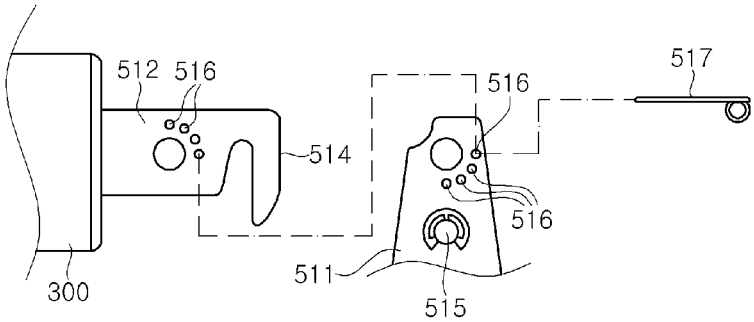
FIG. 2 is a conceptual diagram illustrating an assembled state of an adjusting unit that is an essential part of the optical semiconductor lighting apparatus according to the embodiment of the present invention.

In addition, as illustrated in FIG. 2, the rotatable assembly 510 may further include a plurality of adjustment holes 516 penetrating the first and second portions 511 and 512 along the rotating direction of the second portion 512 with respect to the first portion 511, so as to adjust a tilt angle of the housing 100 with respect to the casing 300.

The rotatable assembly 510 may include a fixing pin 517 (see an assembled state of FIG. 3) penetrating the adjustment hole 516 of the first portion 511 and the adjustment hole 516 of the second portion 512 and connecting thereto, so as to maintain a state in which the tilt angle of the housing 100 is adjusted with respect to the casing 300.

Figure 3:
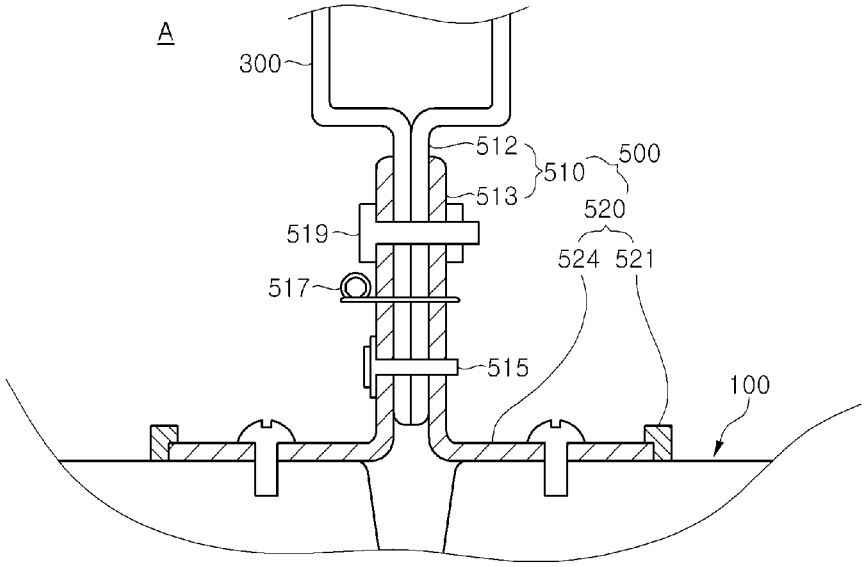
FIG. 3 is a conceptual diagram illustrating an assembled state of an adjusting unit that is an essential part of an optical semiconductor lighting apparatus according to another embodiment of the present invention.

In this case, as illustrated in FIG. 3, the rotatable assembly 510 may further include a third portion 513 detachably connected to the housing 100, instead of the first portion 511 integrally formed in the housing 100 as illustrated in FIGS. 1 and 2, and a second portion 512 provided at one side of the casing 300 and rotating around the third portion 513.

In the embodiment of FIG. 3, applications and design modification can also be made such that the rotatable assembly 510 includes the latch hook 514 and the latch pin 515 as illustrated in FIGS. 1 and 2, and the plurality of adjustment holes 516 are formed so that the latch hook 514 and the latch pin 515 are fixed together by the fixing pin 517.

Meanwhile, the adjustment unit 500 may include a movable assembly 520 that is disposed between the housing 100 and the casing 300 together with the rotatable assembly 510 and allows the casing 300 to be slidable with respect to the housing 100.

In this case, as illustrated in FIG. 3, the movable assembly 520 includes a first rail 521 formed in the housing 100, and a fourth portion 524 connected to the first rail 521, and the fourth portion 524 is connected to the rotatable assembly 510, that is, the third portion 513.

Figure 4:
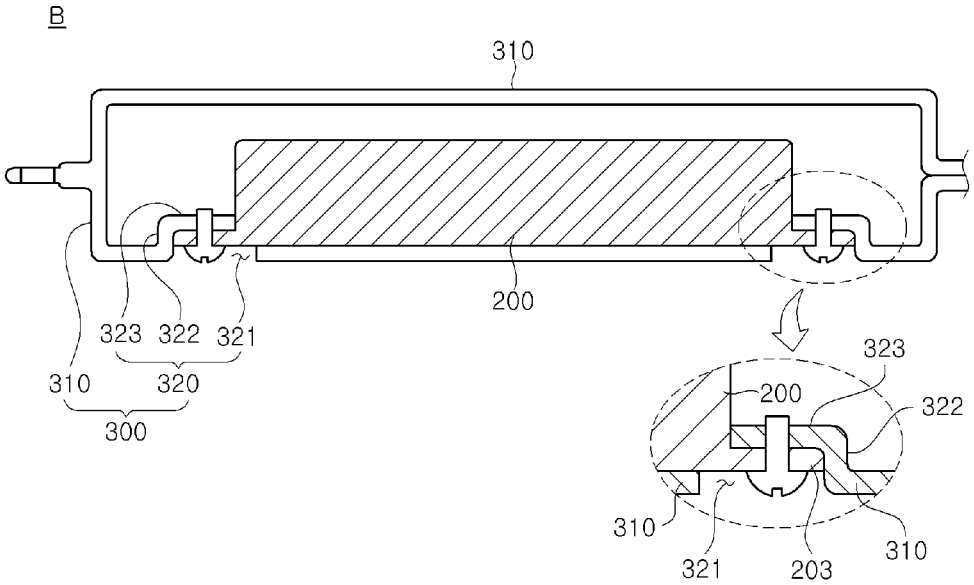
FIG. 4 is a conceptual diagram viewed from a viewpoint B of FIG. 1.

Meanwhile, as described above, the casing 300 provides the space for accommodating the SMPS 200, and may be made of aluminum or an aluminum alloy having superior heat dissipation performance. As illustrated in FIG. 4, the casing 300 includes a main body 310 having an end connected to the housing 100, and a bracket 320 provided at one side of the main body 310. Both ends of the SMPS 200 are connected to the bracket 320.

The bracket 320 includes an extension portion 322 extending toward the inside of the casing 300 from one edge of a cut-off slot 321, which is cut off at one side of the main body 310, and a fixing portion 323 extending in parallel to one side of the casing 300 from an edge of the extension portion 322. Both ends of the SMPS 200 are connected to the fixing portion 323.

In this case, the SMPS 200 further includes contact portions 203 connected to the fixing portions 323 at both sides thereof. As illustrated, the contact portion 203 may be disposed between the fixing portion 323, which extends from the extension portion 322, and the cut-off slot 321, and be fixed by a fastening member such as a bolt.

Meanwhile, embodiments of FIGS. 5 to 9 can also be applied to the present invention.

Figure 5:
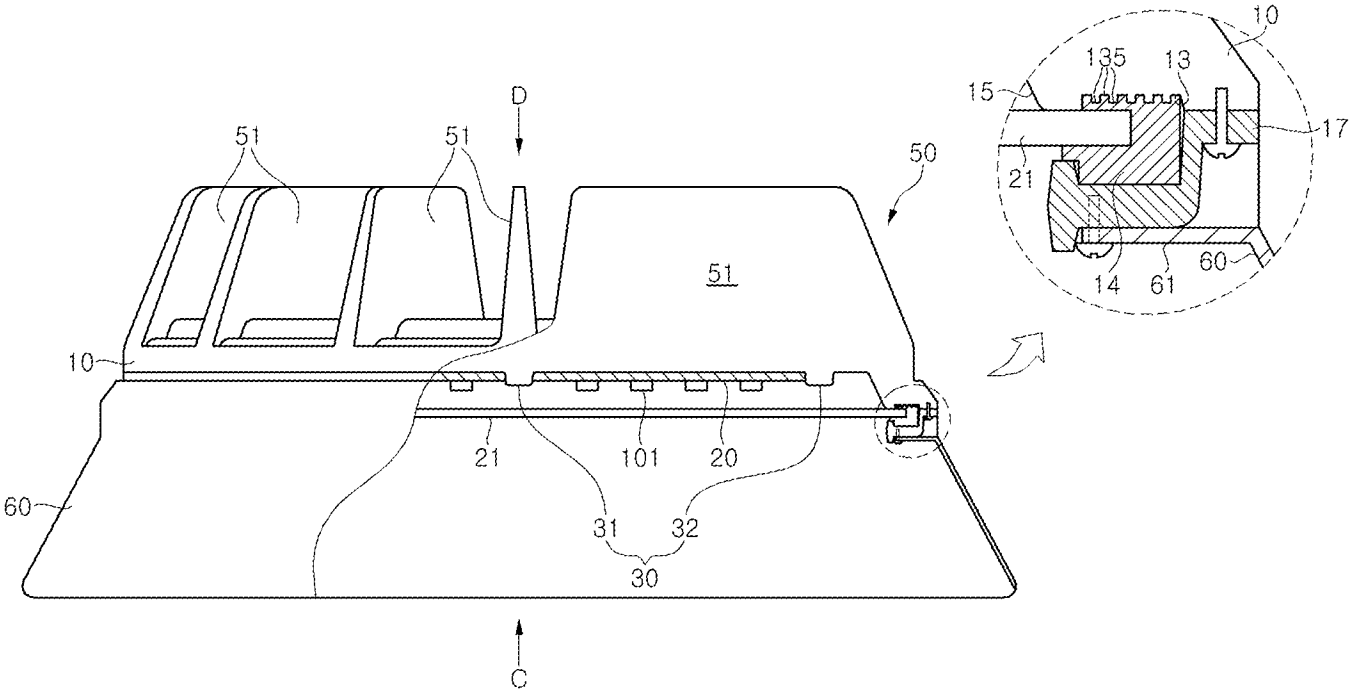
FIG. 5 is a partial cut-away sectional conceptual diagram illustrating an overall configuration of an optical semiconductor lighting apparatus according to another embodiment of the present invention.

FIG. 5 is a partial cut-away sectional conceptual view illustrating an overall configuration of an optical semiconductor lighting apparatus according to another embodiment of the present invention.

As illustrated, the optical semiconductor lighting apparatus according to the embodiment of the present invention is configured such that a light emitting module 20 is arranged by a position determining unit 30 in a housing where a heat sink unit 50 is disposed.

First, the housing 10 provides a space for mounting the light emitting module 20 and serves as a base of the heat sink unit 50.

The light emitting module 20 is disposed on the bottom surface of the housing 10 and includes at least one or more semiconductor optical devices 101. The light emitting module 20 serves as a light source.

The position determining unit 30 is disposed on the bottom surface of the housing 10, and corresponds to an edge of the light emitting module 20. The light emitting module 20 determines an accurate position, where an engine body 70 as a concept of a light engine to be described later will be mounted, and fixes the engine body 70.

In addition, the heat sink unit 50 is disposed on the top surface of the housing 10, and is disposed at a position corresponding to the light emitting module 20, so as to discharge and cool heat generated from the light emitting module 20.

It is apparent that the following various embodiments as well as the above-described embodiment can also be applied to the present invention.

As described above, the housing 10 provides a space for mounting and forming the light emitting module 20 and the heat sink unit 50, and further includes a main reflector 60 connected along an edge of the bottom surface of the housing 10.

In this case, the optical semiconductor lighting apparatus may further include an auxiliary reflector 15 having an inclined surface formed along the inside of the edge of the housing 10, that is, the edge where the main reflector 60 is mounted.

Although not specifically illustrated, a reflection sheet or a material for increasing reflectivity may be coated on the inclined surface of the auxiliary reflector 15.

To be specific, the outer edge of the bottom surface of the housing 10 is connected to a ring-shaped fixing frame 17, and an edge of an optical member 21 corresponding to the light emitting module 20 is fixed between the housing 10 and the fixing frame 17.

The main reflector 60 includes a ring-shaped fixing flange 61 extending inward along the edge thereof, and the fixing flange 61 is connected to the fixing frame 17.

In addition, the optical member 21 is closely fixed by a sealing member 14 such that the edge thereof is air-tightly sealed.

To be specific, a mounting groove 13 is formed in a ring shape along the outer edge of the bottom surface of the housing 10, and a plurality of ring protrusions 135 protrude in a concentric circular shape along a direction in which the mounting groove 13 is formed.

The sealing member 14 is connected to the mounting groove 13 from which the ring protrusions 135 protrude, and the edge of the optical member 21 is closely fixed along the inner surface of the sealing member 14. The sealing member 14 is finished by the fixing frame 17.

Furthermore, as described above, the heat sink unit 50 discharges and cools heat generated from the light emitting module 20, and includes a plurality of heat sink fins 51 protruding from the top surface of the housing 10 in correspondence to the inner area thereof where the edge of the light emitting module 20 is formed.

Figure 6:
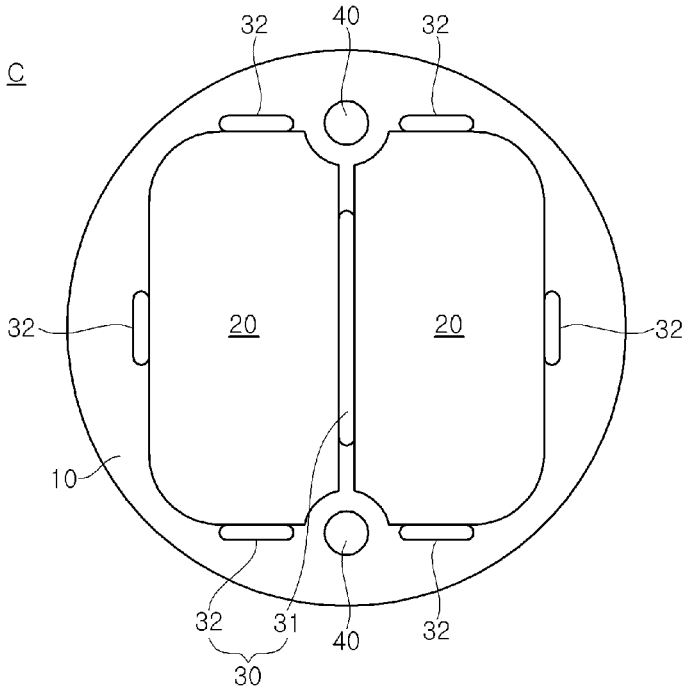
FIGS. 6 to 8 are conceptual diagrams illustrating application examples of position determining units that are an essential part of optical semiconductor lighting apparatuses according to various embodiments of the present invention.
Figure 7:
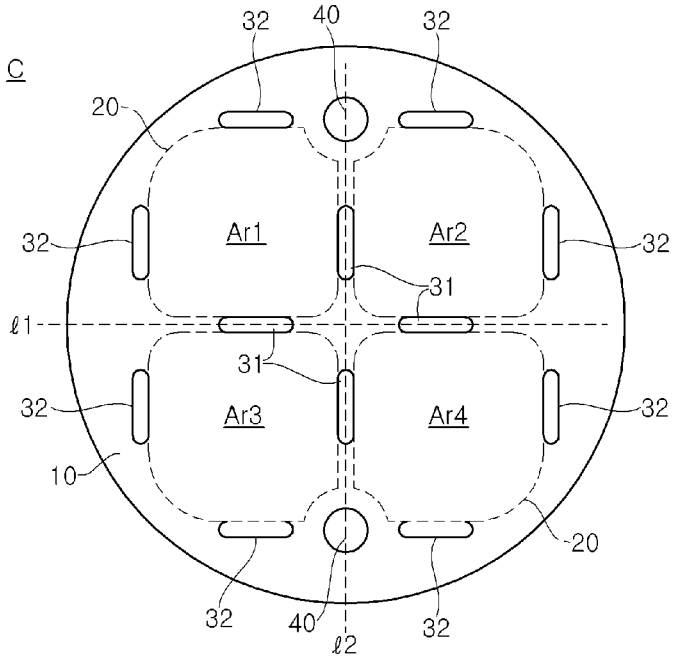

Meanwhile, as described above, the light emitting module 20 serves as a light source, and includes a printed circuit board on which the semiconductor optical devices 101 are arranged. As illustrated in FIGS. 6 and 7, a plurality of mounting areas Ar1, Ar2, Ar3 and Ar4 partitioned by the position determining unit 30 are disposed on the bottom surface of the housing 10.

The position determining unit 30 includes at least one or more first ribs 31 protruding from the bottom surface of the housing 10 in a horizontal or vertical direction, and a plurality of second ribs 32 protruding from the edge of the bottom surface of the housing 10.

Therefore, the light emitting module 20 is disposed in the plurality of mounting areas Ar1, Ar2, Ar3 and Ar4 formed between the first and second ribs 31 and 32.

That is, the position determining unit 30 may be configured such that the first rib 31 is arranged across the center portion of the bottom surface of the housing 10 as illustrated in FIG. 6, or may be configured such that the plurality of first ribs 31 are arranged in a grid shape on a first virtual straight line l1 disposed on the bottom surface of the housing 10 and a second virtual straight line l2 perpendicular to the first virtual straight line l1, as illustrated in FIG. 7.

In this case, waterproof connectors 40 are disposed at the edge of the bottom surface of the housing 10, such that the waterproof connectors 40 are connected to at least one or more external powers.

Figure 8:
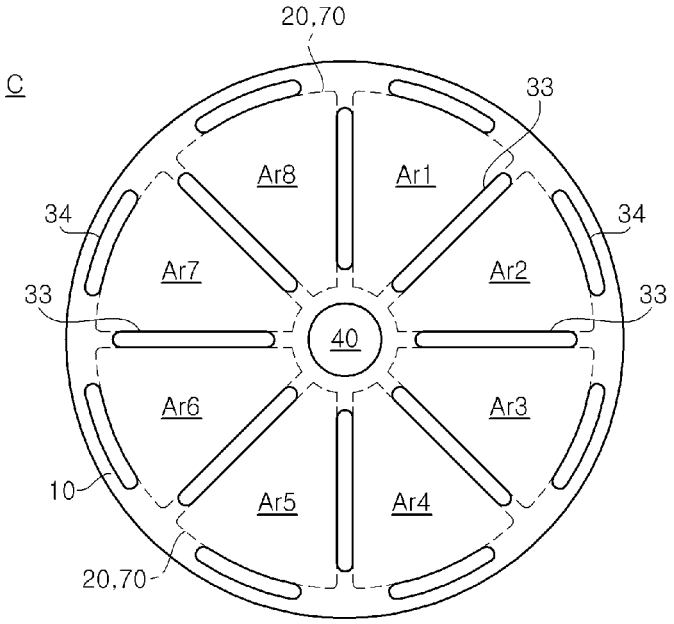

Meanwhile, as illustrated in FIG. 8, the light emitting modules 20 may be disposed in a plurality of mounting areas Ar1 to Ar8 radially partitioned by the position determining unit 30 on the bottom surface of the housing 10, and the waterproof connectors 40 may be disposed in the center of the bottom surface of the housing 10 due to the arrangement structure.

To be specific, the position determining unit 30 includes a plurality of third ribs 33 protruding radially from the center of the bottom surface of the housing 10, and a plurality of fourth ribs 34 protruding from the edge of the bottom surface of the housing 10.

In this case, the light emitting module 20 is disposed in a plurality of mounting areas Ar1 to Ar8 formed between the third and fourth ribs 33 and 34.

Figure 9:
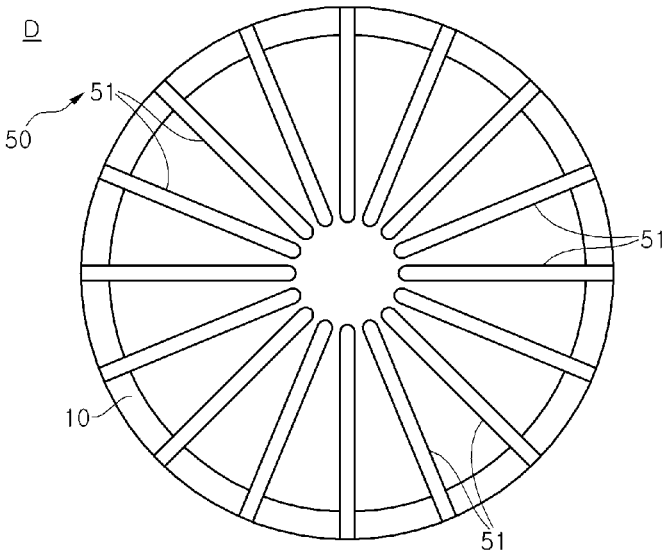
FIG. 9 is a conceptual diagram viewed from a viewpoint D of FIG. 5.

Therefore, as illustrated in FIG. 9, the heat sink unit 50 may be configured to include a plurality of heat sink fins 51 formed radially from the center of the top surface of the housing 10.

In designing the heat sink fins 51, the number of the heat sink fins 51 may be approximately increased or decreased at an early stage according to the number of the semiconductor optical devices 101 and the area and output power of the light emitting module 20.

Furthermore, applications and design modifications can also be made such that the structure of the engine body 70 including semiconductor optical devices (not illustrated) instead of the light emitting module 20, that is, the concept of the light engine, is disposed in the plurality of mounting areas Ar1 to Ar8 partitioned by the position determining unit 30.

Although not specifically illustrated, it should be understood that the engine body 70 refers to a structure that includes a light emitting module (not illustrated) with semiconductor optical devices, and an optical member corresponding to the light emitting module, and the engine body 70 is a structural concept extended up to a combination of a light emitting module and a power unit electrically connected thereto, which is defined in "Zhaga Consortium", the consortium for standardization of LED light engines.

As described above, the basic technical spirit of the present invention is to provide the optical semiconductor lighting apparatus that can significantly reduce transport costs by securing the loading space, be designed to appropriately arrange the semiconductor optical devices serving as the light source and mount the semiconductor optical devices at the accurate positions, and allow the products to be rapidly mass-produced due to the simplified manufacturing process thereof.

According to the present invention, the following effects can be obtained.

The adjusting unit for adjusting the height of the casing is provided between the casing accommodating the SMPS and the housing including the semiconductor optical device. Therefore, more products can be loaded in a limited space. Furthermore, when transporting the products, logistic costs and accommodation costs can be significantly reduced.

Due to the adjusting unit, the height of the casing can be lowered with respect to the housing, and the product can be accommodated and packaged in a box. Therefore, compared with the conventional lighting apparatus, the size of the package box can be reduced. Consequently, the amount of raw materials used can be significantly reduced, and the costs for raw materials can also be significantly reduced.

Using the adjusting unit that can adjust the height of the casing with respect to the housing, the angle of light irradiated from the semiconductor optical device can be adjusted in an actual location where the lighting apparatus is installed, in addition to transport and loading.

Furthermore, the position determining unit is provided on the bottom surface of the housing, such that the light emitting module or the engine body including the semiconductor optical device is appropriately arranged on the bottom surface of the housing. From this configuration, it is possible to design the appropriate arrangement structure of the semiconductor optical device serving as the light source, and it is possible to easily determine the accurate mounting position of the light emitting module or the engine body and install the light emitting module or the engine body.

While the embodiments of the present invention have been described with reference to the specific embodiments, it will be apparent to those skilled in the art that various changes and modifications may be made without departing from the spirit and scope of the invention as defined in the following claims.

What is claimed is:

1. An optical semiconductor lighting apparatus, comprising:

a housing comprising a heat sink unit and a reflector;

a plurality of light emitting modules disposed on a bottom surface of the housing, each light emitting module comprising at least one or more semiconductor optical devices; and a position determining unit disposed on the bottom surface of the housing and corresponding to edges of the light emitting modules, wherein:

the heat sink unit is disposed on a top surface of the reflector and corresponds to the light emitting modules; and the position determining unit comprises a plurality of ribs arranged in more than one direction and configured to partition the bottom surface of the housing into a plurality of mounting areas.

2. The optical semiconductor lighting apparatus of claim 1, wherein the light emitting modules are disposed in the plurality of mounting areas.

3. The optical semiconductor lighting apparatus of claim 2, further comprising at least one waterproof connector disposed at one side of the bottom surface of the housing.

4. The optical semiconductor lighting apparatus of claim 1, wherein:

the position determining unit is configured to radially partition the bottom surface of the housing into the plurality of mounting areas; and the light emitting modules are disposed in the plurality of mounting areas.

5. The optical semiconductor lighting apparatus of claim 4, further comprising a waterproof connector disposed in the center of the bottom surface of the housing.

6. The optical semiconductor lighting apparatus of claim 1, wherein the plurality of ribs comprise:

at least one or more first ribs protruding from the bottom surface of the housing in a horizontal or vertical direction; and a plurality of second ribs protruding from an edge of the bottom surface of the housing, wherein the light emitting modules are disposed in the plurality of mounting areas between the first and second ribs.

7. The optical semiconductor lighting apparatus of claim 6, wherein the first ribs of the position determining unit are disposed across a center portion of the bottom surface of the housing.

8. The optical semiconductor lighting apparatus of claim 6, wherein the first ribs of the position determining unit are arranged on a first virtual straight line, which is disposed on the bottom surface of the housing, and a second virtual straight line, which is perpendicular to the first virtual straight line.

9. The optical semiconductor lighting apparatus of claim 6, wherein the first ribs of the position determining unit are arranged on a plurality of first virtual straight lines, which are disposed on the bottom surface of the housing, and a plurality of second virtual straight lines, which are perpendicular to the first virtual straight lines.

10. The optical semiconductor lighting apparatus of claim 1, wherein the plurality of ribs comprise:

a plurality of third ribs protruding radially from the center of the bottom surface of the housing, and a plurality of fourth ribs protruding from an edge of the bottom surface of the housing, wherein the light emitting modules are disposed in the plurality of mounting areas between the third and fourth ribs.

11. The optical semiconductor lighting apparatus of claim 1, further comprising:

a main reflector connected to an edge of the housing; and an auxiliary reflector having an inclined surface formed along the edge of the housing.

12. The optical semiconductor lighting apparatus of claim 1, wherein the heat sink unit comprises a plurality of heat sink fins protruding from the top surface of the housing corresponding to areas where the edges of the light emitting modules are formed.

13. The optical semiconductor lighting apparatus of claim 1, wherein the heat sink unit comprises a plurality of heat sink fins formed radially from a center of the top surface of the housing.

14. The optical semiconductor lighting apparatus of claim 1, wherein:

the plurality of light emitting modules comprise first and second light emitting modules; and one of the ribs is disposed between the first and second light emitting modules.

15. The optical semiconductor lighting apparatus of claim 1, wherein:

the plurality of mounting areas comprise first and second mounting areas; and one of the ribs is disposed between the first and second mounting areas.

16. An optical semiconductor lighting apparatus, comprising:

a housing comprising a heat sink unit and a reflector;

at least one engine body disposed on a bottom surface of the housing and comprising a semiconductor optical device; and a position determining unit disposed on the bottom surface of the housing and corresponding to an edge of the engine body, wherein:

the heat sink unit is disposed on a top surface of the reflector and corresponds to the engine body; and the position determining unit comprises a plurality of ribs arranged in more than one direction and configured to partition the bottom surface of the housing into a plurality of mounting areas.

17. The optical semiconductor lighting apparatus of claim 16, wherein:

the at least one engine body comprises first and second engine bodies; and one of the ribs is disposed between the first and second engine bodies.

18. The optical semiconductor lighting apparatus of claim 16, wherein:

the plurality of mounting areas comprise first and second mounting areas; and one of the ribs is disposed between the first and second mounting areas.

* * * * *